United States Patent [19]

Nguyen Dat et al.

[11] 4,009,408

[45] Feb. 22, 1977

[54] HIGH-PRESSURE SODIUM-VAPOR DISCHARGE LAMP

[75] Inventors: Nhiep Nguyen Dat, Chatenay Malabry; Maurice Bensoussan, Sevres; Bernard Doucet, Colombes, all of France

[73] Assignee: ITT Industries, Inc., New York, N.Y.

[22] Filed: Oct. 31, 1975

[21] Appl. No.: 627,715

[30] Foreign Application Priority Data

Dec. 16, 1974 France ..... 74.41317

[52] U.S. Cl. ..... 313/198; 316/32; 316/26

[51] Int. Cl.[2] ..... H01J 61/00

[58] Field of Search ..... 313/198; 316/32, 26

[56] References Cited

UNITED STATES PATENTS

| | | | |
|---|---|---|---|
| 2,085,561 | 6/1937 | Wiegand | 313/198 X |
| 3,651,365 | 3/1972 | Waymouth | 313/198 |

FOREIGN PATENTS OR APPLICATIONS

| | | | |
|---|---|---|---|
| 725,761 | 3/1955 | United Kingdom | 313/198 |

*Primary Examiner*—R. V. Rolinec
*Assistant Examiner*—Darwin R. Hostetter
*Attorney, Agent, or Firm*—John T. O'Halloran; Peter C. Van Der Sluys; Richard A. Menelly

[57] ABSTRACT

An improved high-pressure sodium-vapor discharge lamp of the type having an internal starting aid wherein the starting aid comprises an auxiliary electrode formed of a long resistive spiral made of a refractory metal having an electrical resistance range from a few ohms to a few thousand ohms.

4 Claims, 3 Drawing Figures

1
11
41
2
d
14
40
5
3
10
9
16

40
41

5
18
22
2
d
41
42
D
40
32
3
7
6

HIGH-PRESSURE SODIUM-VAPOR DISCHARGE LAMP

BACKGROUND OF THE INVENTION

This invention relates to high-pressure sodium-vapor discharge lamps of the type having a resistive conducting element in the discharge space in order to assist discharge starting when cold.

Copending U.S. patent application Ser. No. 472,011 filed in the U.S. on May 22, 1974 and assigned to the common assignee of this invention, now abandoned, describes improved discharge starting in a high-pressure sodium-vapor discharge lamp by the introduction of a good electrical conductor in the discharge space. The presence of a large-diameter metallic rod or wire, i.e. a low-resistance conducting element, reduces the distance between the ends of the main electrodes across which the discharge is established. The effectiveness of the reduced distance enables the discharge to become established over a shorter distance between the electrodes when the lamp is cold. Once the lamp is started the discharge gradually occurs across the full distance between the electrodes corresponding to the steady-state condition. This low-resistance element described in the above identified application defines a first discharge space relative to either or both main electrodes to facilitate lamp starting across the first discharge space when the lamp is cold. When the lamp becomes heated the discharge then switches to the two main electrodes.

According to the arrangements described in the above identified patent application, an electrically resistive conductor is placed in the discharge space rather than a good electrical conductor, since the presence of a good electrical conductor lowers the physical resistance of the lamp in the steady-state condition, thereby reducing its life. This major disadvantage is the result of local overheating due to the presence of the conducting element in the discharge space. If, as described in the above identified application, a resistive element is employed in the form of a thin film on the wall of the burner, the improved starting of the lamp is offset by the deterioration of the deposited film. The deterioration of this film can produce cracks in the support surface (alumina or other material), resulting in destruction of the lamp.

SUMMARY OF THE INVENTION

In order to overcome these disadvantages without losing the advantage of easy lamp starting, the present invention provides an electrically resistive conducting element within the lamp consisting of a resistive spiral formed from a long thin wire of refractory metal whose resistance is greater than ten ohms and less than several thousand ohms, typically less than 10,000 ohms, for improving the self-starting of a high-pressure sodium-vapor discharge lamp. The coiled starting element is positioned to obtain a smaller discharge space during starting than under steady-state discharge conditions relative to one of the two main discharge electrodes.

The invention also provides a novel high-pressure sodium-vapor discharge lamp manufacturing process wherein the burner is provided with a resistive spiral having a resistance depending upon the fill pressure in the burner under steady-state operation conditions. The spiral is supported by mounting means attached to at least one end of the burner, in order to provide a discharge space during starting of length less than that of the normal operating discharge space under steady-state conditions.

Other characteristics of the invention can be seen from the detailed description below. It should be understood that the description and drawings are given as examples only and are in no way intended to limit the scope of the invention.

DESCRIPTION OF THE PREFERRED EMBODIMENT

Figure 1:
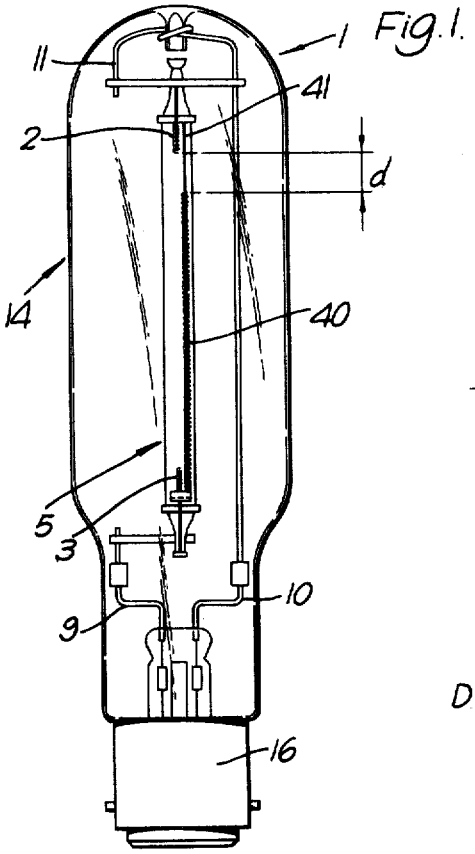
FIG. 1 is a schematic representation of the discharge lamp according to the invention.

FIG. 1 is a schematic drawing of a high-pressure sodium-vapor discharge lamp 1 made in accordance with this invention. Inside lamp 1 are the discharge electrodes 2 and 3 contained in the burner 5, supported by structures 9, 10 and 11 enclosed in a bulb 14, which is the main enclosure of the lamp 1. The base 16 attached to bulb 14 provides the power supply contacts to electrodes 2 and 3. The two supply contacts are insulated from each other. Electrode 2 is fed via support 11, and electrode 3 is electrically connected to support 9. A resistance element 40 wound onto a thin rod 41 is also shown in burner 5. The resistance element 40 provides auxiliary electrode capability during the lamp starting process. This feature will now be explained in greater detail.

Figure 3:
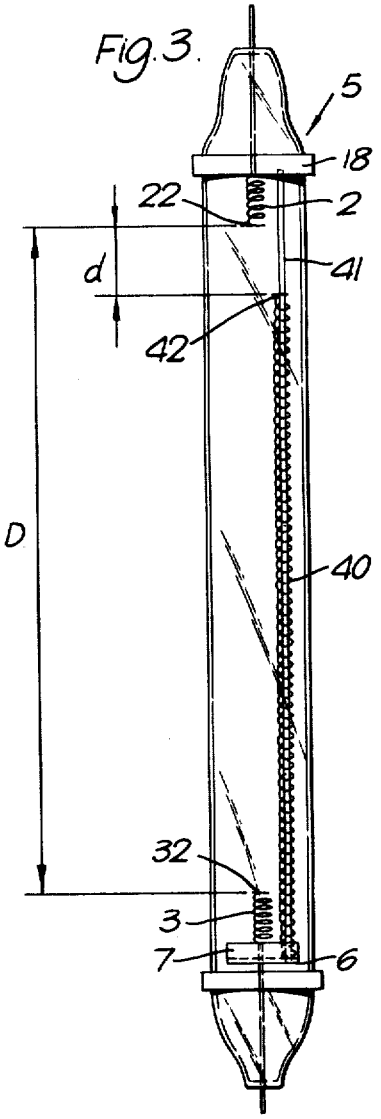
FIG. 3 is an enlarged schematic representation of the burner in the lamp of FIG. 1.

It is the addition of this resistive spiral which provides easy starting of the lamp when fed from mains voltage via a simple ballast choke or capacitor. FIG. 3 shows a space increment "*d*" between the top end 42 of the resistive spiral 40 and the bottom end 22 of electrode 2. This increment is much less than the space D between the free ends 22 and 32 of electrodes 2 and 3, respectively.

Figure 2:
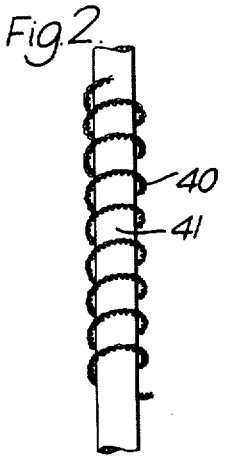
FIG. 2 is a schematic representation of the resistive spiral and support of the lamp of FIG. 1.

FIGS. 2 and 3 show the mounting of the resistive spiral 40. With regard to the value of the resistance of this spiral, it has been determined that the resistance value is related to the pressure in the burner under steady-state operating conditions.

Based on calculations for normal fill pressures in sodium-vapor lamps, it is necessary to provide resistance values between roughly 10 ohms up to several thousand ohms. A long length of wire is required in order to obtain this range of resistance values with a wire of sufficient diameter to be strong in use and easily spiraled.

In the incandescent lamp industry it is necessary to make resistive spirals having good strength and long life at high temperatures. A resistive spiral having these properties has been developed by the incandescent lamp industry and is designated as a "coiled-coil" filament. FIG. 2 shows a coil of this type made from a wire 40 already surrounded by a spiral. The wire 40 is wound onto a rod 41 of insulating material. It is thus possible to obtain a tungsten coiled-coil filament of 700 ohms, for example, of reasonable length which can be easily installed in the burner.

A drilled insulating mounting piece 7 is also provided as shown in FIG. 3. The drilled hole is used for inserting rod 41 having the coiled-coil 40 and is preferably located off-center with respect to the main electrode 3 at the base of the burner. Since the spiral 40 is inserted in the hole, it may be electrically connected with the metallic end piece 6 in electrical contact with electrode 3 to provide an electrical contact that has no detrimental effect on lamp operation.

The other end of rod 41 is attached to the top cap 18, but the spiral 40 ends with its top 42 at a distance "d" from the bottom end 22 of electrode 2.

Manufacture of the burner is then completed in a conventional manner. After filling the lamp with an atmosphere of inert gas, the burner is sealed and installed in the lamp envelope in the usual manner. The lamp is then completed by the installation of its base.

As soon as power is applied to the lamp when cold, a voltage difference is established between the ends 42 and 22 of the resistive spiral 40 and electrode 2, respectively. The close separation distance "*d*" between the spiral 40 and electrode 2 enables the discharge to start when the lamp is cold. As the discharge is established, it progresses gradually to the steady-state condition, covering the discharge space D.

Within the scope of the invention, other forms of resistive spirals and other means for installing and attaching the spirals in the burner can be employed. Electrical connection between the spiral and one of the main electrodes may or may not be provided.

Although the principles of the present invention are described above in relation with specific examples, it should be understood that the description is given as an example only and does not limit the scope of the invention.

What is claimed is:

1. An improved high-pressure sodium-vapor discharge lamp of the type having a pair of discharge electrodes defining a first discharge space within a refractory discharge envelope, and an auxiliary electrode defining a second discharge space relative to the discharge electrodes, wherein the improvement comprises:

forming the auxiliary electrode from a refractory metal spiral wound on an insulating rod supported within the lamp envelope having an electrical resistance value between 10 ohms and 10,000 ohms whereby the lamp starts between said auxiliary electrode and one of said discharge electrodes when the lamp is cold, and operates between the discharge electrodes when the lamp is hot.

2. The lamp of claim 1 wherein said electrical resistance is 700 ohms.

3. The lamp of claim 2 wherein said auxiliary electrode is electrically connected with one of said discharge electrodes.

4. A method for manufacturing an improved high-pressure sodium-vapor discharge lamp of the type having an auxiliary electrode in combination with two discharge electrodes within a lamp envelope including the steps of:

providing a refractory metal spiral on an insulating rod, said spiral having a resistance value from 500 –700 ohms;

mounting said insulated rod within said discharge envelope, said resistive spiral proximate one of said discharge electrodes for providing lamp starting therebetween said electrodes when the lamp is cold;

filling said lamp with a sodium compound and an inert gas; and sealing said lamp to atmosphere.

* * * * *